US007794200B2

(12) United States Patent
Mukherjee

(10) Patent No.: US 7,794,200 B2
(45) Date of Patent: Sep. 14, 2010

(54) TURBOCHARGER WITH A VARIABLE NOZZLE DEVICE

(75) Inventor: Shankar Mukherjee, Bellflower, CA (US)

(73) Assignee: Honeywell International, Inc., Morristown, NJ (US)

( * ) Notice: Subject to any disclaimer, the term of this patent is extended or adjusted under 35 U.S.C. 154(b) by 882 days.

(21) Appl. No.: 10/559,205

(22) PCT Filed: May 8, 2003

(86) PCT No.: PCT/IB03/01786

§ 371 (c)(1),
(2), (4) Date: Dec. 4, 2006

(87) PCT Pub. No.: WO2004/099573

PCT Pub. Date: Nov. 18, 2004

(65) Prior Publication Data

US 2007/0071595 A1 Mar. 29, 2007

(51) Int. Cl.
*F01D 17/12* (2006.01)

(52) U.S. Cl. ..... 415/164; 415/165

(58) Field of Classification Search ..... 415/160, 415/163, 164, 165, 209.3
See application file for complete search history.

(56) References Cited

U.S. PATENT DOCUMENTS

| | | | | |
|---|---|---|---|---|
| 3,033,519 | A * | 5/1962 | Radtke | 415/164 |
| 4,659,295 | A * | 4/1987 | Burdette et al. | 417/407 |
| 6,679,057 | B2 * | 1/2004 | Arnold | 60/602 |
| 7,322,791 | B2 * | 1/2008 | Stilgenbauer | 415/164 |

FOREIGN PATENT DOCUMENTS

JP 60175707 A * 9/1985

* cited by examiner

*Primary Examiner*—Edward Look
*Assistant Examiner*—Ryan H Ellis

(57) ABSTRACT

A turbocharger comprises a center housing (3) and a turbine housing (1) with a variable nozzle device arranged there between. The turbocharger further comprises an annular arrangement of adjustable vanes (7) interposed in an annular nozzle (9) for defining a plurality of nozzle passages, wherein the vanes (7) are axially resiliently supported on the center housing (3) or the turbine housing (601), respectively.

7 Claims, 8 Drawing Sheets

TURBOCHARGER WITH A VARIABLE NOZZLE DEVICE

The invention relates to a turbocharger with a variable nozzle device.

In the prior art there are known turbines of turbochargers for internal combustion engines comprising a variable nozzle device with an annular arrangement of vanes forming a plurality of nozzle passages therebetween.

In document U.S. Pat. No. 4,242,040 there is disclosed a turbocharger with a variable nozzle device with adjustable vanes. The variable nozzle device comprises in particular an unison ring provided with radially inclined slots for accommodating vane tabs. The side of each vane opposite to the side facing the unison ring has a pin which is rotatably supported in a corresponding hole of the turbine housing, so that the pins of the vanes can freely rotate in the respective holes in the turbine housing when the inclination of the vanes is adjusted by a rotation of the unison ring. The unison ring is actuated by an actuating mechanism.

According to the further document GB-861,630, there is known a mounting of rotatable blades for the diffusor of a centrifugal compressor. In this construction the pivoting pins of the vanes are carried by an annular slidibly mounted wall which, by means of a press ring, is pressed against the opposite wall of the diffusor, thereby achieving a tight arrangement of the vanes in the nozzle formed between the two walls. The press ring is urged by a plurality of springs accommodated in respective holes of the turbine housing.

According to the further document WO-A1-0244527 there is known a turbocharger with a turbine comprising on the side of the turbine housing a cylindrical piston. The cylindrical piston is axially movable, in order to modify the cross-section of an exhaust gas nozzle, in which adjustable vanes are interposed. By means of this arrangement, the geometry and flow characteristics of the nozzle passages can be modified.

It is an object of the invention to provide an improved turbocharger with a variable nozzle device.

The inventors have found out that the operation of variable nozzle turbochargers leads very often to the loss of gap between a nozzle face formed by the turbine housing and a center housing flange. The vane sticking resulting therefrom leads inevitably to an overboost of the internal combustion engine. A further consequence of the overboost can be a progressive damage to the engine cylinder head. An overboost leads also to an over-speeding of the turbine wheel resulting in wheel's wear and bearing damage.

The object of the invention can be achieved in particular by the combination of the features set forth in claim 1. Preferable embodiments of the invention are defined in the subclaims.

The object of the invention can be achieved in particular by a turbocharger comprising a center housing and a turbine housing with a variable nozzle device arranged there between and further comprising an annular arrangement of adjustable vanes interposed in an annular nozzle for defining a plurality of nozzle passages, wherein the vanes are axially resiliently supported toward the center housing or the turbine housing, respectively.

According to a particular embodiment of such turbocharger the vanes are axially resiliently supported against the center housing via an annular plate extending substantially coaxially to the annular arrangement of the vanes and being elastically biased toward the center housing or the turbine housing, respectively, by a resilient device, preferably a spring device.

In a particular preferred embodiment of the turbocharger according to the invention the springs of the resilient device are arranged in bores of the center housing and act on projections of the annular plate extending within the bores so that the annular plate is urged against a step portion formed on the turbine housing.

According to an alternative solution of the object of the invention, there is provided a self-aligning spring mechanism which automatically releases the binding load on the vanes and thus prevents the vanes from sticking. Such self-aligning spring mechanism preferably comprises an annular plate formed as a plate spring extending substantially coaxially to the annular arrangement of the vanes and being elastically biased toward the center housing or the turbine housing, respectively.

The above and other alternative or modified solutions according to the invention will be illustrated in the following on the basis of several embodiments as examples with reference to the enclosed figures.

Figure 1:
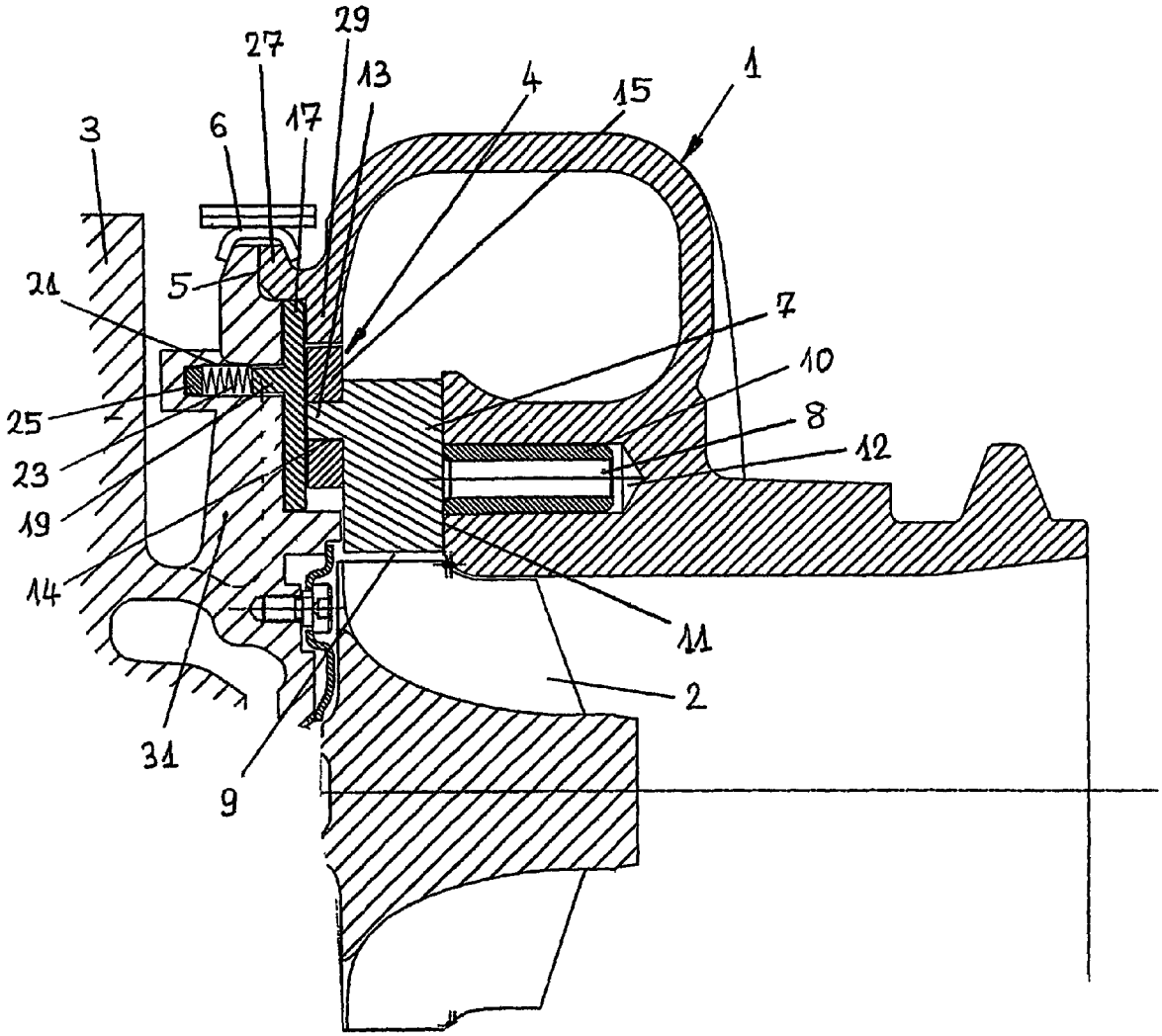
FIG. 1 shows an extract cross-sectional view of a variable nozzle device arranged between the center housing and the turbine housing of a turbocharger.
Figure 2:
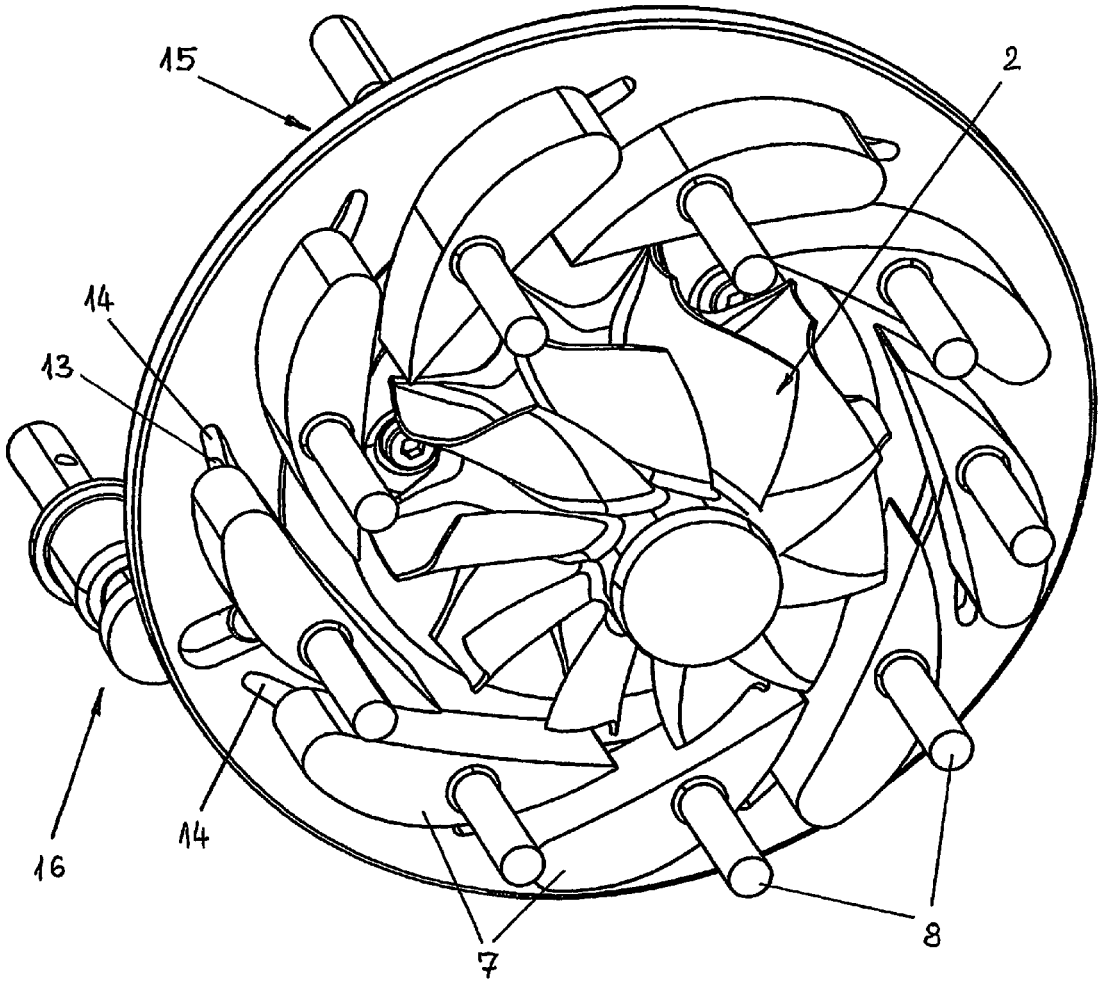
FIG. 2 shows a perspective view of the variable nozzle device of FIG. 1.
Figure 3:
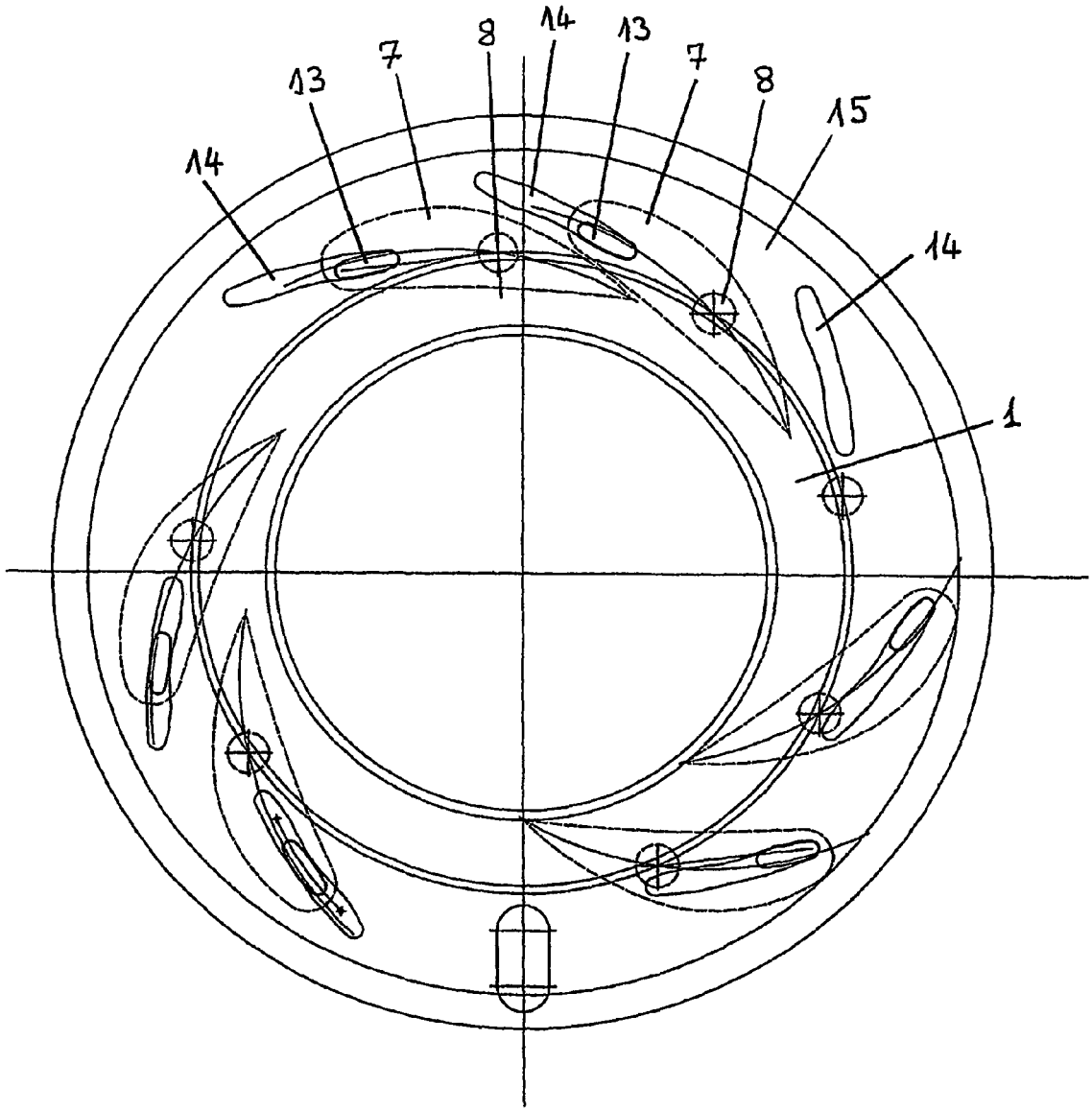
FIG. 3 shows a front view of the unison ring with three different positions of a pair of vanes being attached behind the unison ring for illustrating the function of the variable nozzle device.

As shown in FIGS. 1, 2 and 3 the turbine side of a turbocharger for an internal combustion engine is constituted by a turbine housing 1 which is secured to a center housing 3 by means of v-band 6. In FIG. 1 there are illustrated the respective flange portions of the turbine housing and the center housing which are abutted against each other along a radially extending coupling surface 5. Between the turbine housing 1 and the center housing 3 there is sandwiched a variable nozzle device 4.

The variable nozzle device 4 comprises an annular arrangement of vanes 7 which are arranged in a ring-shaped nozzle 9 extending between a nozzle face 11 of the turbine housing 1 and an unison ring 15 about a turbine 2 as particularly shown in FIG. 2. Each vane 7 has a pin 8 which is accommodated in a bushing 10 pressed in a corresponding hole 12 of the turbine housing 1 at the side of the nozzle face 11. On the side of the vanes facing the unison ring 15 each vane is provided with a tab 13 engaging in a corresponding slot 14 of the unison ring extending in a radially inclined direction. Thus, the vane tab 13 serves as an actuating portion for pivotally turning the corresponding vane 7 about the respective pin 8 and changing its position in the nozzle 9. The unison ring 15 is rotatable by means of a crank mechanism 16 for adjusting the pivotal position of the vanes 7.

The length of the tabs 13 is such that they preferably project from the unison ring 15 toward an annular adjuster plate 17. The annular adjuster plate 17 is provided at its side facing the center housing 3 with piston-like projections or studs 19 which are arranged in a circumferentially spaced manner from each other and accommodated in bores 21 formed in a flange 31 of the center housing 3.

Figure 4:
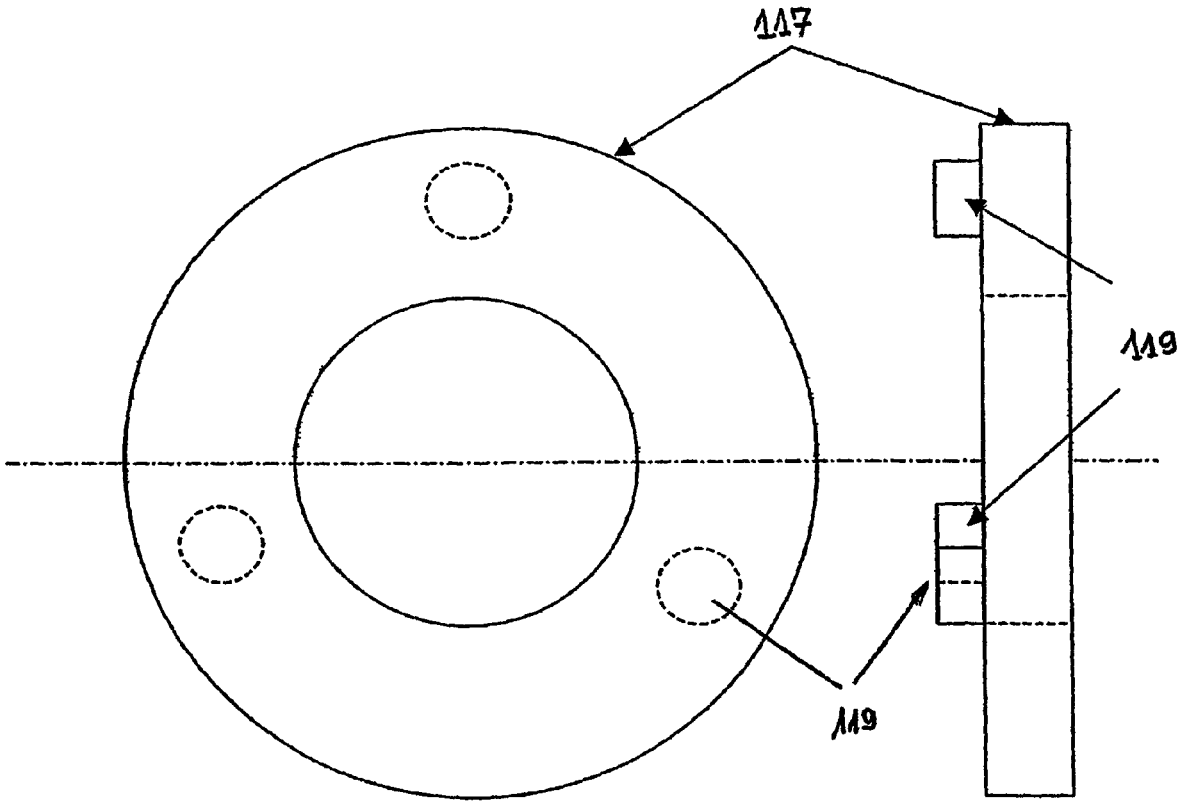
FIG. 4 shows a front view and a side view of an embodiment of the annular plate as a part of the variable nozzle device.

A particular design of the annular adjuster plate 117 with three piston-like studs 119 being arranged in a circumferentially spaced manner is shown in FIG. 4. However, if desired there can be provided more than three studs, wherein also the cross-section form of the studs can be also appropriately varied depending on the form of the matching holes 31.

Between each stud 19 and the bottom portion of the respective bore 21 there is provided a spring device constituted by an axially extending coil spring 23 and a spring base plug 25 serving as adjusting support.

The spring device can be pre-fabricated by attaching the spring 23 to the plug 25 using a brazing or soldering process. In the first step of assembling the spring base plug 25 is fitted into the respective bore 21. In a further step, the vanes 7 with the unison ring 15 are assembled into the turbine housing 1. Then the annular adjuster plate 17 is put in the flange portion 27 of the turbine housing 1, so that it rests against a step portion 29 of the turbine housing 1 with the studs 19 pointing away from the turbine housing in axial direction. Subsequently the center housing 3 and the spring device are assembled into the turbine housing 1 such that the studs 19 of the annular adjuster plate 17 slide into the corresponding bores 21 of the center housing 3 and come into abutment with the springs 23 so that the adjuster plate 17 is slightly pressed against the step portion 29.

Finally, the center housing 3 is secured to the turbine housing 1 by means of not particularly shown v-band or bolts, so that in the fully assembled state of the turbine, the studs 19 slightly compress the springs 23 and a small clearance between the adjuster plate 17 and the flange 31 of the center housing remains. In this assembled state also a small clearance is established between the vane tab 13 and the adjuster plate 17.

During the operation of the turbocharger, it happens that the turbine housing with its nozzle face 11, the unison ring 15, the vanes 7 or even other parts of the variable nozzle device and the vane mechanism are distorted axially such that the gap between the nozzle face 11 of the turbine housing and the center housing flange 31 is reduced and the vane tabs 13, the unison ring 15 or other parts of the vane mechanism expand to the left in FIG. 1.

However, due to the particular arrangement in this embodiment, instead of touching the center housing 3, causing the aforementioned "vane sticking" and preventing the vanes from being freely adjustable, the aforementioned parts only touches the adjuster plate 17 which is resiliently displaced to the left in FIG. 1 by compressing the springs 23.

The arrangement of the spring device and the corresponding studs can be designed and constructed in a different manner.

Figure 5:
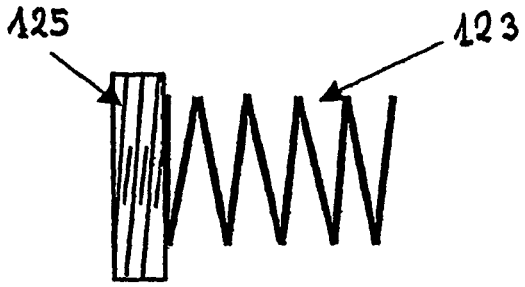
FIG. 5 shows a spring device arrangement according to a first embodiment.

According to an embodiment shown in FIG. 5 the plug 125 can be threaded so that it can be exactly positioned into the respective bore of the center housing by means of a screw driver.

Figure 6:
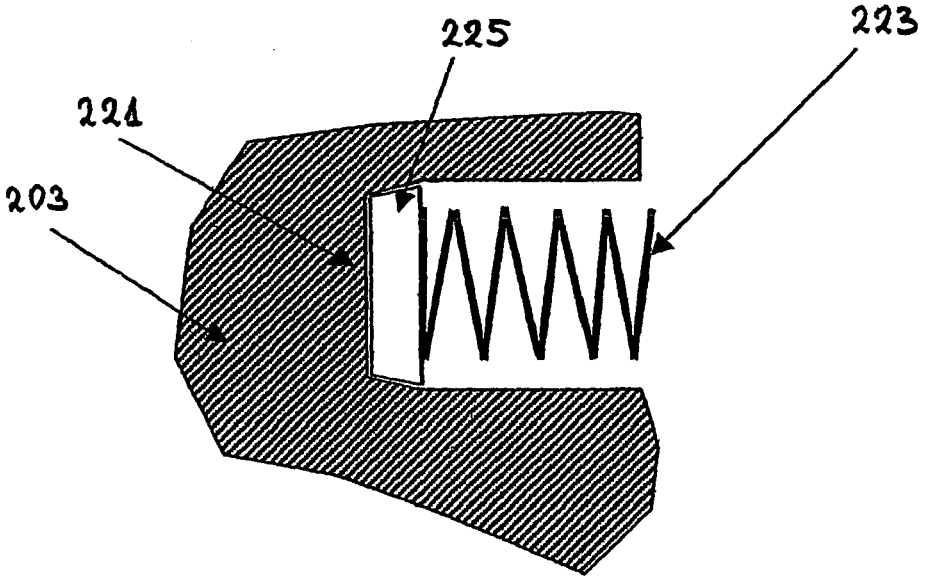
FIG. 6 shows a spring device arrangement according to a second embodiment.

FIG. 6 shows another possibility for designing the spring device, where the plug 225 is made of a slide taper. Such a taper can be forceably inserted into the respective bore 221 of the center housing 203. In order to achieve an interference fit, the spring plug 225 can simply be pushed into the respective bore 221 with the screwdriver and hammer.

Figure 7:
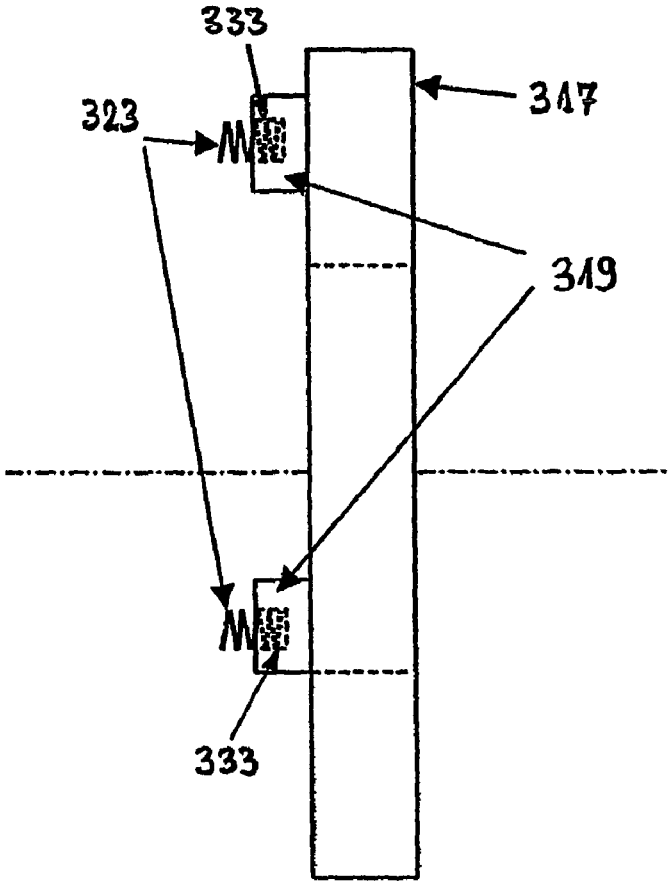
FIG. 7 shows a spring device arrangement incorporated in the annular adjuster plate according to a third embodiment.

According to a further embodiment shown in FIG. 7 the bores in the center housing and the corresponding studs 319 provided in each adjuster plate 317 can be formed significantly larger than the diameter of the springs 323. In such a case, a recess 333 is provided in each stud 319 as shown in FIG. 7, so that the spring device can be placed within the corresponding recess. After the adjustable vane mechanism has been assembled into the turbine housing, the adjuster plate with the springs is then placed in the turbine housing, so that it rests on the step portion 29 shown in FIG. 1. Finally, the center housing 3 shown in FIG. 1 is assembled such that the springs 323 protruding from the adjuster plate 317 slide into the corresponding bores along the studs 319. The center housing is then secured to the turbine housing by means of v-band or bolts not particularly shown in the figures.

Figure 8:
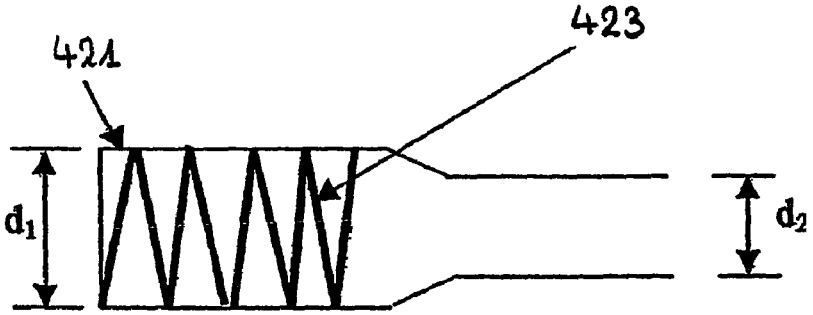
FIG. 8 illustrates a spring member used in a fourth embodiment of the spring device.

As illustrated by a further embodiment shown in FIG. 8, each bore 421 can be formed as a multi-diameter bore having at least two portions with diameters $D_1$ and $D_2$, respectively, wherein $D_1>D_2$. When using such a construction, the respective spring 423 is cooled down, in particular by means of a dry ice or other cooling method, so that the diameter of the spring 423 shrinks to a diameter less than $D_2$. Each spring 423 is then slid into the corresponding bore 421 of the center housing until it rests against the back of the corresponding hole where the diameter is $D_1$. After heating-up to room temperature, the spring will increase in diameter, so that its nominal diameter will become greater than $D_2$ and thus the spring will be prevented from sliding out. The diameter $D_2$ can be preferably chosen such that there is a minimal interference between the holes and the springs at room temperature.

The above assembling method can be modified such that, instead of cooling the springs, the mounting thereof into the center housing can be achieved also by heating the center housing, so that the flange and the holes in the flange grow in diameter. The spring can then be slided in the multi-diameter bore and finally the center housing can be allowed to cool down to room temperature.

Figure 9:
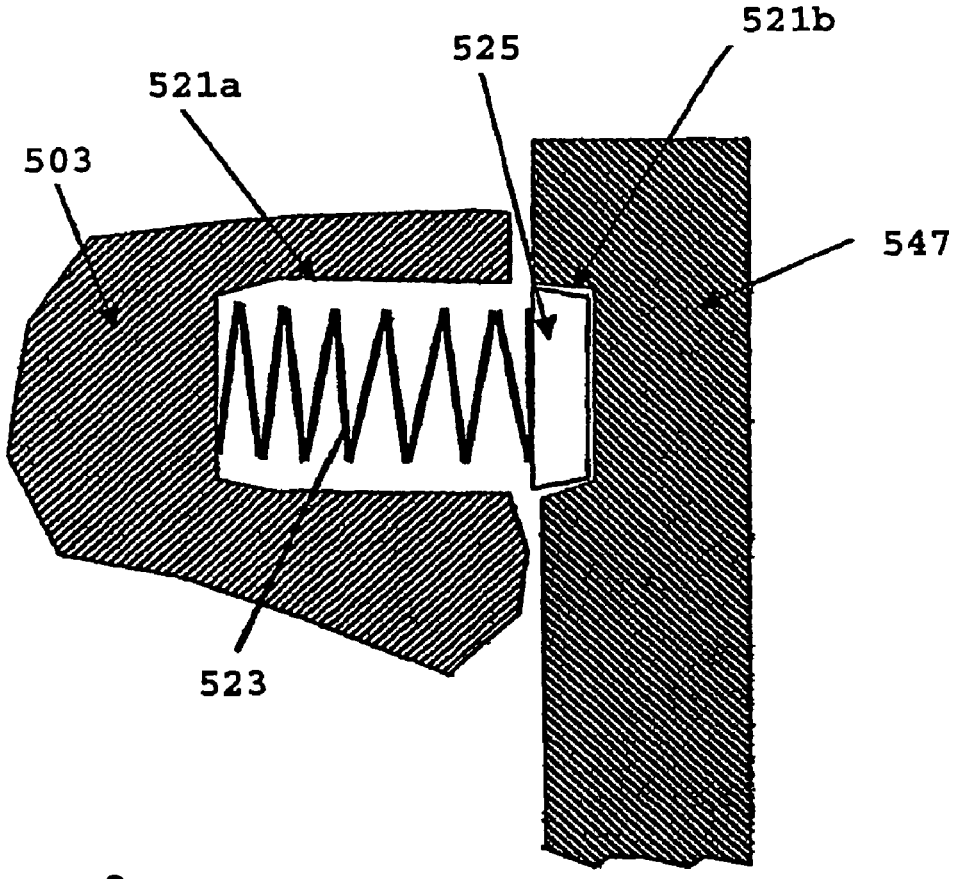
FIG. 9 illustrates a fifth embodiment of the spring device.

A fifth embodiment shown in FIG. 9 illustrates a spring device the position of which between the annular adjuster plate 517 and the center housing 503 is inverted compared to the embodiment shown in FIG. 6. In this embodiment the plug 525 is made of a slide taper which is inserted into a bore 521*b* of the annular adjuster plate 517. The bore 521*b* faces a coaxially corresponding bore 521*a* formed in the center housing 503 so that the spring 523 can easily slide therein when assembling the turbine. The taper of the plug 525 can be threaded or forceably inserted into the respective bore 521*b* of the adjuster plate 517, or even secured therein by means of an interference fit.

Further embodiments and modifications of the invention can be achieved by the person skilled in the art by merely combining elements of one or several of the embodiments described above.

Figure 12:
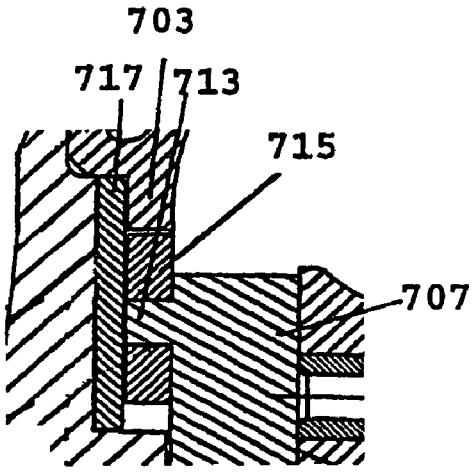
FIG. 12 shows another embodiment of a variable nozzle device.

According to a further embodiment of the turbocharger according to the invention as shown in FIG. 12, the adjuster plate can be designed as a plate spring 717 which serves for resiliently abutting the vane 707 tabs 713 and/or the unison ring 715 against the center housing 703. By means of such an arrangement the use of particular studs, springs and holes in the center housing can be omitted.

In a further preferred embodiment the adjuster plate can be made of very compliant material which is able to take up the deformation caused by the respective vane tab pushing into it without causing the parts to bind.

Figure 10:
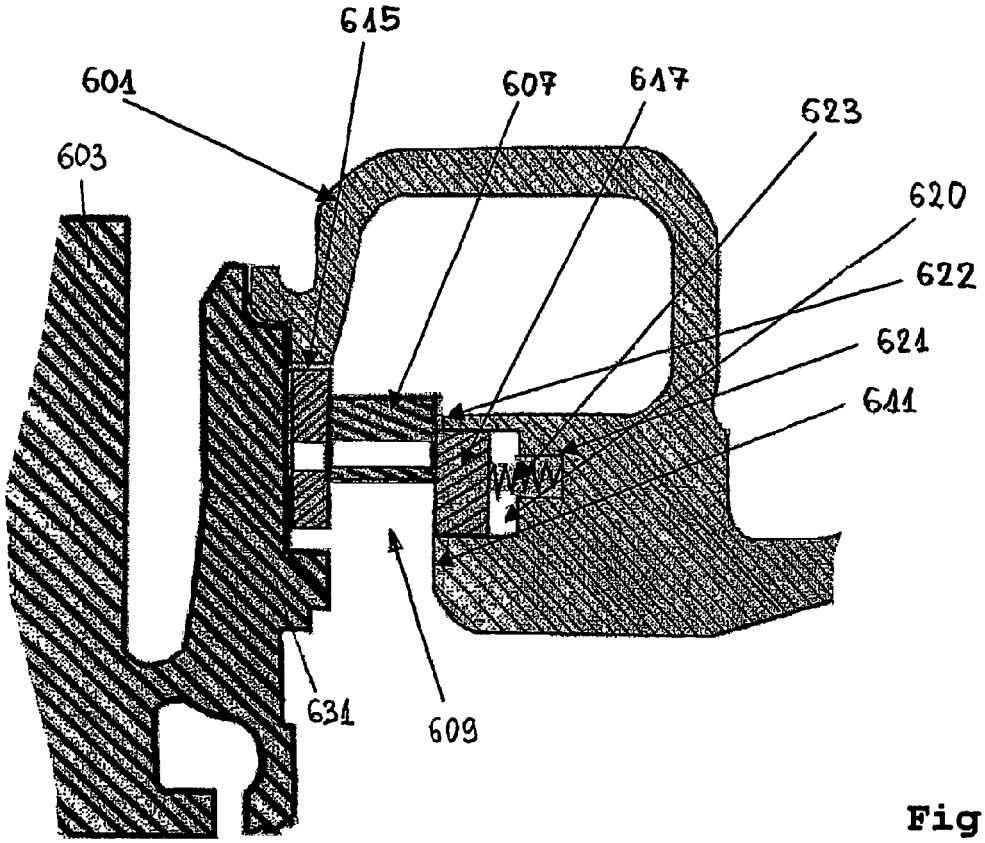
FIG. 10 shows an extract cross-sectional view of a variable nozzle device arranged between the center housing and the turbine housing of a turbocharger according to a further embodiment of the invention.
Figure 11:
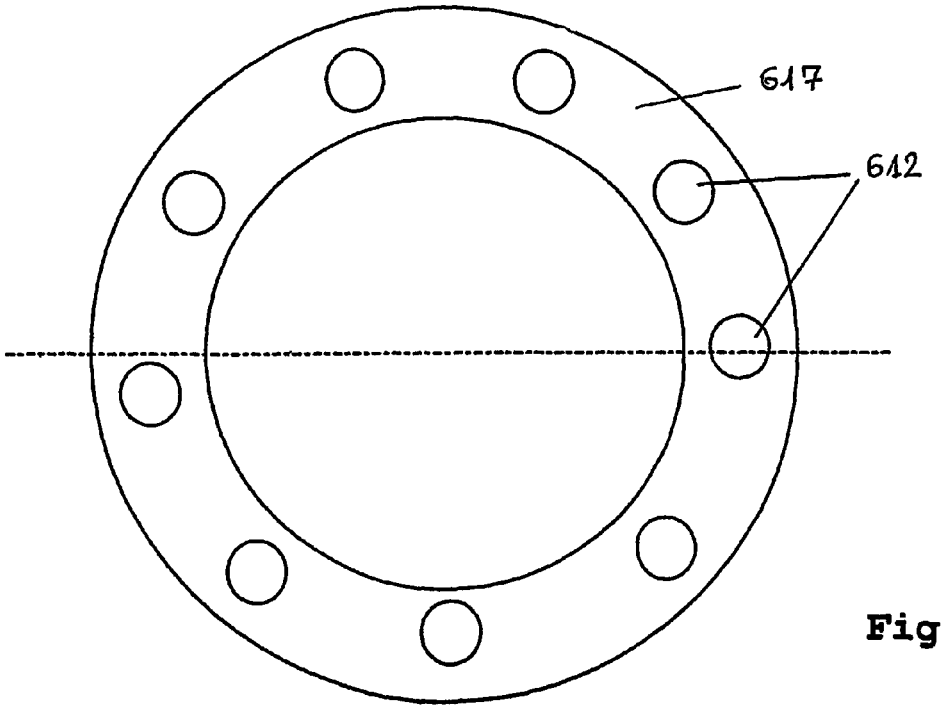
FIG. 11 shows a front view of the adjuster plate of variable nozzle device in FIG. 10.

According to a further embodiment of the invention shown in FIG. 10 the adjuster plate 617 is positioned in a ring-shaped slot 620 cut in the nozzle face 611 of the turbine housing 601. The top portion 622 of the nozzle face above the outer diameter of the slot 620 is machined so that when the adjuster plate 617 is placed in the slot and is lined up with the bottom part of the nozzle face 611, it projects out of the top portion 622 of the nozzle face and thus a gap is established between the vanes 607 and the top portion 622 of the nozzle face. At the bottom of the ring-shaped slot 620 three or more holes are drilled at specified angular intervals for receiving coil springs 623 of approximately the same diameter, said springs being abutted against the adjuster plate 617 for urging the adjuster plate against the ring-shaped arrangement of the vanes 607. As further shown in FIG. 11 the adjuster plate 617 is provided with a plurality of holes 612 for receiving corresponding pins of the vanes 607.

For assembling the variable nozzle device according to this further embodiment, the turbine housing 601 is initially placed such that the open end of the slot 620 and the holes 621 are pointing up. Then the coil springs 623 are placed in the holes 621 and subsequently the annular adjuster plate 617 is placed in the slot 620 such that the face of the adjuster plate exposed to the hot gas in the nozzle 609 lines-up with the bottom part of the nozzle face 611 and projects out at the top part 622 of the nozzle face. Thus, the adjuster plate 617 takes over the function of the nozzle face 611 for the purposes of gas flow control through the nozzle 609. As a next step the vanes 607 and the unison ring 615 are assembled into the turbine housing 601 and then the center housing 603 is attached to the turbine housing 601.

During operation of the variable nozzle device the vanes 607 do not initially touch the top portion 622 of the nozzle face and there is a gap therebetween as shown in FIG. 10. When a loss of gap axially between the turbine housing nozzle face 611 and the center housing flange 631 occurs due to thermo-deformation of the different components, the vanes 607 put pressure on the adjuster plate 617 which moves inwardly in the ring-shaped slot 620 depending on the resistance of the springs 623. The result of such movement is that the binding load on the vanes is released and a vane sticking is efficiently avoided. When the axial distortion of the turbocharger components reduces, the adjuster plate 617 moves out of the slot 620 back into its original position due to the loading force of the springs 623.

The form and arrangement of the adjuster plate 617 with the pertinent resilient device including the springs 623 can be modified according to each of the embodiments explained above with reference to the FIGS. 4 to 9.

The invention claimed is:

1. A turbocharger, comprising:

a center housing;

a turbine housing;

a variable nozzle device between the center housing and the turbine housing;

wherein the variable nozzle device includes an annular arrangement of adjustable vanes interposed in an annular nozzle to define a plurality of nozzle passages, a unison ring configured to pivotally adjust the vanes in the nozzle, and a resilient device abutting the unison ring;

wherein the resilient device is compressed against the unison ring to resiliently exert an axial force against the vanes.

2. A turbocharger according to claim 1, wherein the resilient device comprises an annular plate extending substantially coaxially to the annular arrangement of the vanes and being elastically biased by springs toward the center housing or the turbine housing.

3. A turbocharger according to claim 2, wherein said springs are a plurality of springs arranged in a plurality of bores of the center housing and act on projections of said annular plate extending within the bores.

4. A turbocharger according to claim 1, wherein the resilient device comprises an annular plate formed as a plate spring extending substantially coaxially to the annular arrangement of the vanes and being elastically biased toward the center housing or the turbine housing.

5. A turbocharger according to claim 1, wherein the resilient device is compressed between the center housing and the unison ring such that it resiliently exerts an axial force urging the unison ring against the vanes, and urging the vanes against the turbine housing.

6. A turbocharger according to claim 1, wherein each vane includes a tab engaging a corresponding slot in the unison ring and extending toward the resilient device.

7. A turbocharger according to claim 1, wherein the resilient device is an annular adjustor plate including at least three spring device studs extending through respective bores in the turbocharger housing.

* * * * *